US012344971B2

(12) United States Patent
Lo et al.

(10) Patent No.: US 12,344,971 B2
(45) Date of Patent: Jul. 1, 2025

(54) KNITTED FABRIC WITH CONCAVE-CONVEX PATTERN

(71) Applicant: HENG SHENG INVESTMENT LTD., Tortola (VG)

(72) Inventors: King-Hang Lo, Taipei (TW); Shi-Yang Chen, Taipei (TW)

(73) Assignee: HENG SHENG INVESTMENT LTD., Tortola (VG)

( * ) Notice: Subject to any disclaimer, the term of this patent is extended or adjusted under 35 U.S.C. 154(b) by 0 days.

(21) Appl. No.: 18/389,849

(22) Filed: Dec. 20, 2023

(65) Prior Publication Data

US 2025/0092585 A1 Mar. 20, 2025

(30) Foreign Application Priority Data

Sep. 19, 2023 (TW) ..... 112135656

(51) Int. Cl.

| | |
|---|---|
| ***D04B 1/10*** | (2006.01) |
| ***D04B 1/12*** | (2006.01) |
| ***D04B 1/16*** | (2006.01) |
| ***D04B 1/24*** | (2006.01) |

(52) U.S. Cl.

CPC ..... *D04B 1/102* (2013.01); *D04B 1/16* (2013.01); *D04B 1/24* (2013.01); *D04B 1/12* (2013.01); *D10B 2331/10* (2013.01); *D10B 2501/043* (2013.01)

(58) Field of Classification Search

None

See application file for complete search history.

(56) References Cited

U.S. PATENT DOCUMENTS

| | | | | |
|---|---|---|---|---|
| 3,413,824 | A * | 12/1968 | Kuney | D04B 15/665 66/170 |
| 10,178,884 | B2 * | 1/2019 | Suzuki | D04B 1/18 |
| 10,179,960 | B2 * | 1/2019 | Diaz | A41C 3/0057 |
| 10,544,528 | B2 * | 1/2020 | Tuscia | B32B 27/12 |
| 10,849,386 | B2 * | 12/2020 | Edwards | B32B 5/245 |
| 10,945,482 | B2 * | 3/2021 | Schoppel | D04B 1/102 |
| 11,166,516 | B2 * | 11/2021 | Fraser | A43B 23/0215 |
| 11,208,744 | B2 * | 12/2021 | Urbelis | A41D 31/245 |
| 11,299,829 | B2 * | 4/2022 | Meir | D04B 15/362 |

(Continued)

FOREIGN PATENT DOCUMENTS

| | | | |
|---|---|---|---|
| CN | 110725049 A | * | 1/2020 |
| CN | 113737377 B | * | 9/2022 |

(Continued)

*Primary Examiner* — Grace Huang

(74) *Attorney, Agent, or Firm* — McClure, Qualey & Rodack, LLP

(57) ABSTRACT

A knitted fabric is knitted from at least three sets of thermoplastic polyurethane (TPU) yarns and has a technical face and a technical back opposite to each other. The knitted fabric has a concave-convex pattern region and a flat plane region continuously knitted with the concave-convex pattern region. In the flat plane region, loops in the technical face are disposed corresponding to loops in the technical back in a one-to-one manner. In the concave-convex pattern region, the number of loops in the technical face is less than the number of loops in the technical back, so the concave-convex pattern region is arched toward the technical back with respect to the flat plane region.

14 Claims, 4 Drawing Sheets

(56) References Cited

U.S. PATENT DOCUMENTS

| | | | | |
|---|---|---|---|---|
| 11,492,736 | B2 * | 11/2022 | Dorjgurkhem | D04B 1/123 |
| 11,674,244 | B2 * | 6/2023 | Meir | A43B 23/04 66/170 |
| 11,680,345 | B2 * | 6/2023 | Brinkman | D04B 1/24 66/170 |
| 12,077,888 | B2 * | 9/2024 | Vitarana | A41C 3/12 |
| 2004/0168479 | A1 * | 9/2004 | McMurray | D04B 1/16 66/202 |
| 2016/0090670 | A1 * | 3/2016 | Meir | A43B 23/0205 66/190 |
| 2019/0208862 | A1 * | 7/2019 | Poegl | A43B 1/04 |
| 2022/0170190 | A1 * | 6/2022 | Pan | D04B 1/24 |
| 2022/0192280 | A1 * | 6/2022 | Burton | D04B 1/24 |
| 2024/0324724 | A1 * | 10/2024 | Dedonato | D04B 21/18 |

FOREIGN PATENT DOCUMENTS

| | | | | |
|---|---|---|---|---|
| JP | 4773786 | B2 * | 9/2011 | D04B 21/16 |
| WO | WO-03012183 | A1 * | 2/2003 | D02G 3/38 |

* cited by examiner

KNITTED FABRIC WITH CONCAVE-CONVEX PATTERN

BACKGROUND OF THE INVENTION

1. Field of the Invention

The invention generally relates to a knitted fabric. Particularly, the invention relates to a knitted fabric with a naturally formed concave-convex pattern after knitting.

2. Description of the Prior Art

When conventional knitted fabrics are to be formed with the concave-convex pattern, a mold with the desired pattern is generally used to perform the hot-press process on the flat plane of the knitted fabric, so a concave-convex pattern region corresponding to the desired pattern is formed on the flat plane of the knitted fabric. However, such a concave-convex pattern formed by hot-pressing not only requires extra cost for the corresponding mold, but also requires additional working hours for the hot-press process, significantly reducing productivity and increasing the possibility of product defects.

SUMMARY OF THE INVENTION

It is an object of the invention to provide a knitted fabric, which has a designed textured structure to naturally form the concave-convex pattern by knitting.

It is another object of the invention to provide a knitted fabric, whose textured structure is knitted from thermoplastic polyurethane (TPU) yarns and can be completely reused to improve the environmental friendliness.

In an embodiment, the invention provides a knitted fabric knitted from at least three sets of thermoplastic polyurethane (TPU) yarns. The knitted fabric has a technical face and a technical back opposite to each other. The knitted fabric has a concave-convex pattern region and a flat plane region continuously knitted with the concave-convex pattern region. In the flat plane region, loops in the technical face are disposed corresponding to loops in the technical back in a one-to-one manner. In the concave-convex pattern region, the number of loops in the technical face is less than the number of loops in the technical back, so the concave-convex pattern region is arched toward the technical back with respect to the flat plane region.

In an embodiment, the at least three sets of TPU yarns include a first set of TPU yarns, a second set of TPU yarns, and a third set of TPU yarns. The first set of TPU yarns, the second set of TPU yarns, and the third set of TPU yarns are all TPU single-component yarns.

In an embodiment, the first set of TPU yarns, the second set of TPU yarns, and the third set of TPU yarns independently include one or more yarns selected from a group consisting of a TPU air textured yarn, a TPU pre-oriented yarn, a TPU draw textured yarn, and a combination thereof.

In an embodiment, the first set of TPU yarns, the second set of TPU yarns, and the third set of TPU yarns include a same yarn material.

In an embodiment, the first set of TPU yarns and the second set of TPU yarns have the same number of yarns. The number of yarns of each of the first set of TPU yarns and the second set of TPU yarns is larger than the number of yarns of the third set of TPU yarns.

In an embodiment, the number of yarns of each of the first set of TPU yarns and the second set of TPU yarns is two or more. The number of yarns of the third set of TPU yarns is one or more and less than the number of yarns of the first set of TPU yarns or the second set of TPU yarns by at least one yarn.

In an embodiment, the second set of TPU yarns is configured to form only the technical back of the knitted fabric.

In an embodiment, in the concave-convex pattern region, the loops in the technical face are formed by the third set of TPU yarns, and the loops in the technical back are alternately formed by the first set of TPU yarns and the second set of TPU yarns.

In an embodiment, a tightness of the concave-convex pattern region is 1.4 to 1.8 times of a tightness of the flat plane region.

In an embodiment, in the concave-convex pattern region, the loops in the technical face are disposed corresponding to the loops in the technical back at interval, so the technical face is concave, and the technical back is convex.

In an embodiment, in the knitted fabric, a vertical projection area of the flat plane region is larger than a vertical projection area of the concave-convex pattern region.

In an embodiment, in the concave-convex pattern region, the loops in the technical face are not interknitted with the loops in the technical back to form a hollow portion.

In an embodiment, in the concave-convex pattern region, the number of the loops in the technical face is defined as Nf. The number of the loops in the technical back is defined as Nb. The relationship of Nf and Nb satisfies the following equation: $(\frac{1}{2}\times Nb)-1 \leq Nf \leq (\frac{1}{2}\times Nb)+1$, wherein Nf and Nb are both positive integers.

In an embodiment, the knitted fabric is a knitted shoe upper.

Compared with the prior art, the knitted fabric of the invention can have a naturally formed concave-convex pattern after knitting by controlling, in the concave-convex pattern region, the number of loops in the technical face to be less than the number of loops in the technical back, eliminating the need of a mold for hot-pressing to form the concave-convex pattern and the consideration of using yarn materials with different thermal shrinkage rates, which are knitted and then heated to shrink them into a concave-convex shape. Furthermore, the knitted fabric of the invention using at least three sets of TPU yarns can reduce the problems of fabric surface defects caused by different tensions, different frictional resistances, or different elastic factors resulted from using yarns of different materials and can effectively improve the quality and increase the productivity.

DETAILED DESCRIPTION OF THE PREFERRED EMBODIMENT

Figure 1B:
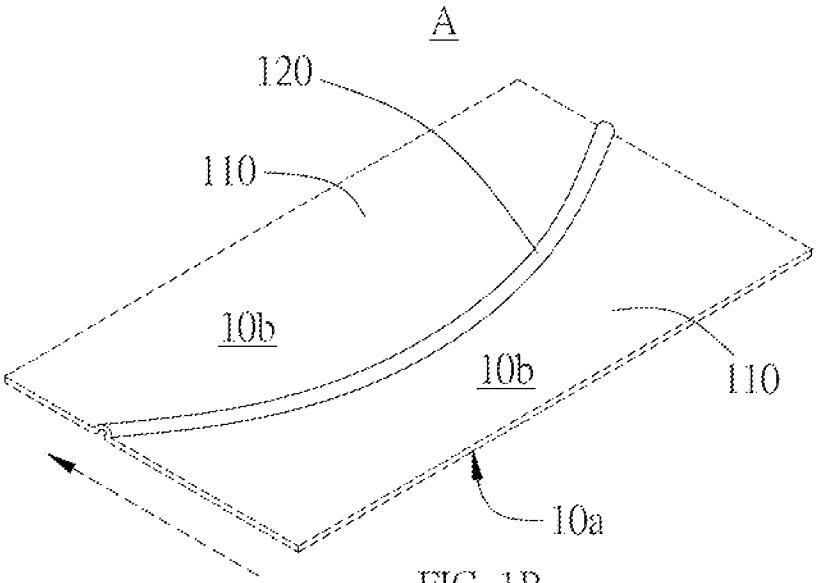
FIG. 1B is a schematic enlarged three-dimensional view of the region "A" of FIG. 1A.

In the drawings, the thickness of layers, films, panels, regions, etc., are exaggerated for clarity. Like reference numerals designate like elements throughout the specification. It should be understood that, even though the terms such as "first", "second", "third" may be used to describe an element, a part, a region, a layer and/or a portion in the present specification, but these elements, parts, regions, layers and/or portions are not limited by such terms. Such terms are merely used to differentiate an element, a part, a region, a layer and/or a portion from another element, part, region, layer and/or portion. Therefore, in the following discussions, a first element, portion, region, layer or portion may be called a second element, portion, region, layer or portion, and do not depart from the teaching of the present disclosure.

The terminology used herein is only for the purpose of describing particular embodiments and is not restrictive. As used herein, unless the content clearly indicates, the singular forms "a", "an", and "the" are intended to include the plural forms, including "at least one." "Or" means "and/or". As used herein, the term "and/or" includes any and all combinations of one or more of the associated listed items. It should also be understood that when used in this specification, the terms "comprising" and/or "including" specify the presence or addition of the described features, regions, wholes, steps, operations, elements and/or components, but do not exclude one or the presence or addition of multiple other features, regions, wholes, steps, operations, elements, components, and/or combinations thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

In order to provide a thorough understanding of the invention, details of steps and structures will be described. Well-known knitting methods and steps are not described in detail to avoid unnecessary limitations of the invention.

The invention provides a knitted fabric, which can be used to manufacture clothes, shoes, or bags, but not limited thereto. The knitted fabric of the invention can be knitted/weaved by any suitable knitting machine (not shown), which can be a circular knitting machine or a flat knitting machine, for example. In an embodiment, the knitted fabric of the invention is made by using a double-bed flat knitting machine, and after finishing the knitting process, the knitted fabric is naturally formed with a concave-convex pattern. For example, the knitted fabric of the invention can be knitted by using the double-bed flat knitting machine with movable cams, which can change the moving direction and drive the actions of the needles.

Figure 1A:
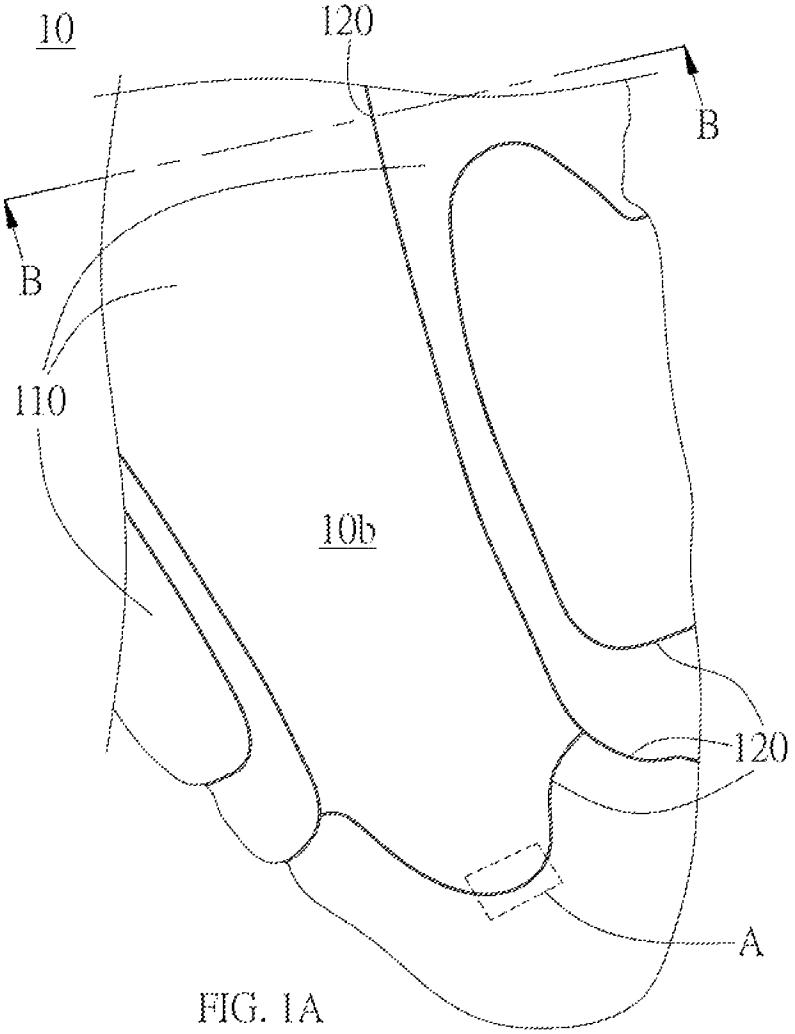
FIG. 1A is a schematic view of the knitted fabric in an embodiment of the invention.
Figure 2:
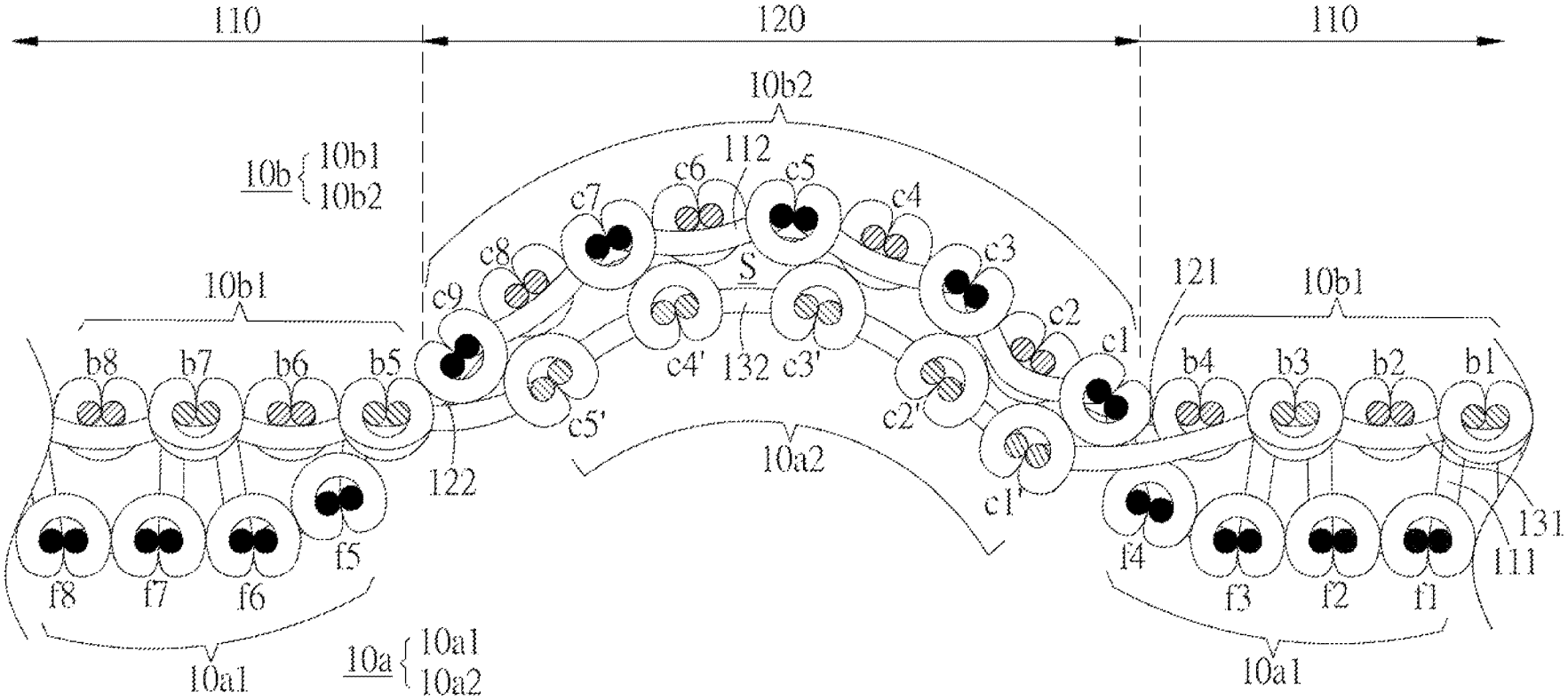
FIG. 2 is a partial cross-sectional schematic view along the cutting line B-B in FIG. 1A.

FIG. 1A is a schematic view of the knitted fabric in an embodiment of the invention; FIG. 1B is a schematic enlarged three-dimensional view of the region "A" of FIG. 1A; FIG. 2 is a partial cross-sectional schematic view along the cutting line B-B in FIG. 1A. As shown in FIG. 1A, FIG. 1B, and FIG. 2, in an embodiment, the knitted fabric 10 preferably is a knitted shoe upper, but not limited thereto. The knitted fabric 10 can be implemented as any fabric in need of a concave-convex pattern. The knitted fabric 10 is preferably knitted from at least three sets of thermoplastic polyurethane (TPU) yarns (as described later). The knitted fabric 10 has a technical face 10*a* and a technical back 10*b* opposite to each other, i.e., front surface and back surface. The knitted fabric 10 includes a concave-convex pattern region 120 and a flat plane region 110. The flat plane region 110 is continuously knitted with the concave-convex pattern region 120. In the flat plane region 110, loops in the technical face 10*a*1 are substantially disposed corresponding to loops in the technical back 10*b*1 in a one-to-one manner. In the concave-convex pattern region 120, the number of loops in the technical face 10*a*2 is less than the number of loops in the technical back 10*b*2, so the concave-convex pattern region 120 is arched toward the technical back 10*b* with respect to the flat plane region 110.

Specifically, the technical face 10*a* corresponds to the portion of the knitted fabric 10 that is formed by the front needle bed of the double-bed flat knitting machine, and the technical face 10*a* is constituted by the technical face 10*a*1 in the flat plane region 110 and the technical face 10*a*2 in the concave-convex pattern region 120. The technical back 10*b* corresponds to the portion of the knitted fabric 10 that is formed by the back needle bed of the double-bed flat knitting machine, and the technical back 10*b* is constituted by the technical back 10*b*1 in the flat plane region 110 and the technical back 10*b*2 in the concave-convex pattern region 120. Moreover, as shown in FIG. 1A, in the knitted fabric 10, the vertical projection area of the flat plane region 110 is larger than the vertical projection area of the concave-convex pattern region 120. Accordingly, the flat plane region 110 can be considered as the whole region of the knitted fabric 10, and the concave-convex pattern region 120 can be regarded as a pattern presented in the flat plane region 110.

As shown in FIG. 2, the phrase "in the flat plane region 110, loops in the technical face 10*a*1 are substantially disposed corresponding to loops in the technical back 10*b*1 in a one-to-one manner" refers to that in the flat plane region 110, the number of loops in the technical face 10*a*1 and the number of loops in the technical back 10*b*1 are identical (only 8 loops for each technical front/back shown in the figure) or different by ±1 loop, so the loops (e.g. f1~f8) in the technical face 10*a*1 and the loops (e.g. b1~b8) in the technical back 10*b*1 are alternately disposed from front to back. Consequently, the flat plane region 110 of the knitted fabric 10 will have relatively flat technical face 10*a*1 and technical back 10*b*1.

As shown in FIG. 2 again, in the concave-convex pattern region 120, the loops in the technical face 10*a*2 are disposed corresponding to the loops in the technical back 10*b*2 at interval, so with respect to the flat plane region 110, the technical face 10*a*2 is concave, and the technical back 10*b*2 is convex. For example, in the concave-convex pattern region 120, the loops (e.g. c1'~c5') in the technical face 10*a*2 are knitted on the front needle bed by missing one stitch between adjacent loops. The loops (e.g. c1~c9) in the technical back 10*b*2 are continuously (fully) knitted on the back needle bed, so the number of loops included in the technical face 10*a*2 is about ½ of the loops included in the technical back 10*b*2. Specifically, the number of loops in the technical face 10*a*2 is defined as Nf, and the number of loops in the technical back 10*b*2 is defined as Nb. The relationship of Nf and Nb should satisfy the equation: $(\frac{1}{2}\times Nb)-1 \leq Nf \leq (\frac{1}{2}\times Nb)+1$, wherein Nf and Nb are both positive integers. For example, in the embodiment of FIG. 2, the number of loops (e.g. c1~c9) of the technical back 10*b*2 is nine (i.e., Nb is 9), and the equation is: $(\frac{1}{2}\times 9)-1 \leq Nf \leq (\frac{1}{2}\times 9)+1$ (i.e., $3.5 \leq Nf \leq 5.5$), so the number of loops of the technical face 10*a*2 can be 4 or 5 (i.e., Nf=4 or 5). In this embodiment, Nf is 5. From another aspect, in the concave-convex pattern region 120, the number of loops Nf of the technical face 10*a*2 can be ½ of the total of the number of loops Nb of the technical back 10*b*2 plus the number of common loops. For example, in the embodiment of FIG. 2, the technical back 10*b*2 includes nine loops (e.g. c1~c9, i.e., Nb=9), and the number of common loops shared by the technical front 10*a* and the technical back 10*b* (such as loop b5) is one, so the number of loops Nf of the technical face 10*a*2 is five (i.e., Nf=5). Since the number of loops of the technical face 10*a*2 is about ½ of the number of loops of the technical back 10*b*2, the technical face 10*a*2 is formed as a concave shape, and the technical back 10*b*2 is formed as a convex shape, resulting in a significant textured feature that the concave-convex pattern region 120 is arched toward the technical back 10*b* with respect to the flat plane region 110.

Moreover, the knitted fabric 10 may have different tightness in the flat plane region 110 and the concave-convex pattern region 120. The tightness of the concave-convex pattern region 120 is preferably larger than the tightness of the flat plane region 110, so the concave-convex pattern region 120 is contracted with respect to the flat plane region 110, further facilitating the arch of the concave-convex pattern region 120 toward the technical back 10*b* with respect to the flat plane region 110. In an embodiment, the tightness of the concave-convex pattern region 120 is preferably 1.4 to 1.8 times of the tightness of the flat plane region 110. In an embodiment, by controlling the yarn-feeding speed of the knitted fabric 10, the tightness of the flat plane region 110 and the concave-convex pattern region 120 can be adjusted. For example, when the yarn-feeding speed for the flat plane region 110 is 600 meters per hour (i.e., 600 m/min), the yarn-feeding speed for the concave-convex pattern region 120 can be controlled to about 333.33~428.57 m/min, so the yarns of the concave-convex pattern region 120 are stretched. After the knitting process is completed, the concave-convex pattern region 120 will contract (or shrink) with respect to the flat plane region 110 due to the restoring force of the yarn, so the concave-convex pattern region 120 is arched toward the technical back 10*b* with respect to the flat plane region 110 to form a semi-circle like arch, and the knitted fabric has a more obvious concave-convex pattern effect.

Moreover, as shown in FIG. 2, in the concave-convex pattern region 120, the loops (e.g. c1'~c5') in the technical face 10*a*2 are not interknitted (or interlaced) with the loops (e.g. c1~c9) in the technical back 10*b*2 to form a hollow portion S therebetween. Specifically, except the common loop b5 shared by the flat plane region 110 and the concave-convex pattern region 120 or the continuous loops f4, c1 of the flat plane region 110 and the concave-convex pattern region 120, the front loops of the concave-convex pattern region 120 (e.g. loops c1'~c5' in the technical face 10*a*2) and the back loops of the concave-convex pattern region 120 (e.g. loops c1~c9 in the technical back 10*b*2) are not interknitted with each other, so the hollow space S without interlaced yarns is formed between the technical face 10*a*2 and the technical back 10*b*2 along the loops-forming direction.

As described above, the knitted fabric 10 can be knitted from at least three sets of TPU yarns. In this embodiment, the at least three sets of TPU yarns include a first set of TPU yarns 11, a second set of TPU yarns 12, and a third set of TPU yarns 13 (shown in FIG. 3 and FIG. 4). The first set of TPU yarns 11, the second set of TPU yarns 12, and the third set of TPU yarns 13 are preferably all TPU single-component yarns, so the whole structure of the knitted fabric 10 uses 100% TPU material yarns, which can be completely recycled and reused. For example, the first set of TPU yarns 11, the second set of TPU yarns 12, and the third set of TPU yarns 13 can independently include one or more yarns selected from a group consisting of TPU air textured yarns (TPU/ATY), TPU pre-oriented yarn (TPU/POY), TPU draw textured yarn (TPU/DTY), and a combination thereof. In an embodiment, the first set of TPU yarns 11 and the second set of TPU yarns 12 preferably have the same number of yarns. The number of yarns of each of the first set of TPU yarns 11 and the second set of TPU yarns 12 is preferably larger than the number of yarns of the third set of TPU yarns 13. For example, the number of yarns of each of the first set of TPU yarns 11 and the second set of TPU yarns 12 can be two or more, and the number of yarns of the third set of TPU yarns 13 can be one or more and less than the number of yarns of the first set of TPU yarns 11 or the second set of TPU yarns 12 by at least one yarn, but not limited thereto. In another embodiment, the number of yarns of each set of TPU yarns can be modified according to practical applications, so the flat plane region 110 of the knitted fabric 10 will have a relatively uniform thickness.

TPU air textured yarn is made by the air-jet texturing process, which interlaced filaments in the jet to cause the loops to be locked firmly in the yarn structure. TPU air textured yarn has the properties of both filament and spun yarns. TPU air textured yarn is a kind of bulked yarns with crimps and loops and has a cotton-like handfeel while maintaining the advantage and functionality of filament yarns, such as bulk, softness, good wicking, bright color fastness, gloss, air permeability, etc., which are better than the filament before texturing. TPU air textured yarn has a fineness higher than that of the filament by about 10-15%, but the strength is lowered by about 40% because only a small portion of filament bears the tensile force of the entire filament after the air texturing process. TPU air textured yarn has not only high stretchability, but also excellent wear resistance. Due to the loop structure on the surface of TPU air textured yarn, TPU air textured yarn can be processed at a speed higher than 6000 stitch/min without melting or breaking. In other words, in considerations of cotton-like handfeel, maintaining the functionality and versatility of artificial fibers, choosing TPU air textured yarn is advantageous. In an embodiment, TPU air textured yarn preferably has a linear mass density of 150 D (denier)~550 D, more preferably 500 D.

TPU pre-oriented yarn refers to the incompletely drawn chemical fiber filament obtained by high-speed spinning with an orientation degree between unoriented yarns and drawn yarns. Compared with undrawn yarns, TPU pre-oriented yarn has a certain degree of orientation and good stability and is often used as a specific yarn for draw textured yarns (DTY). The high-speed spinning usually has a speed of 3000-6000 m/min, and winding yarn at a spinning speed of 4000 m/min or less will have a higher degree of orientation. TPU pre-oriented yarns have high pre-orientation, stable properties, good mechanical properties, high uniformity, and good processing properties. In an embodiment, TPU pre-oriented yarn preferably has a linear mass density of 130 D~250 D, more preferably 200 D.

TPU draw textured yarn is formed by using TPU pre-oriented yarn as the filament, which is drawn and twisted. TPU draw textured yarn has a certain degree of elasticity and shrinkage, also known as TPU elastic yarn. In an embodiment, TPU draw textured yarn preferably has a linear mass density of 150 D~350 D, more preferably 165 D.

In an embodiment, the first set of TPU yarns 11, the second set of TPU yarns 12, and the third set of TPU yarns 13 can include the same yarn material. For example, the three sets of TPU yarns can be all TPU air textured yarns, TPU pre-oriented yarns, or TPU draw textured yarns, but not limited thereto. In another embodiment, the first set of TPU yarns 11, the second set of TPU yarns 12, and the third set of TPU yarns 13 can include different or partially identical yarn materials. For example, the three sets of TPU yarns can be TPU air textured yarn, TPU pre-oriented yarn, and TPU draw textured yarn, respectively. Alternatively, the first set of TPU yarns 11 and the second set of TPU yarns 12 each can include two or more TPU yarns made by same or different processes, and the TPU yarn included in the third set of TPU yarns 13 can be the same as or different from that of the first set of TPU yarns 11 and the second set of TPU yarns 12.

Figure 3:
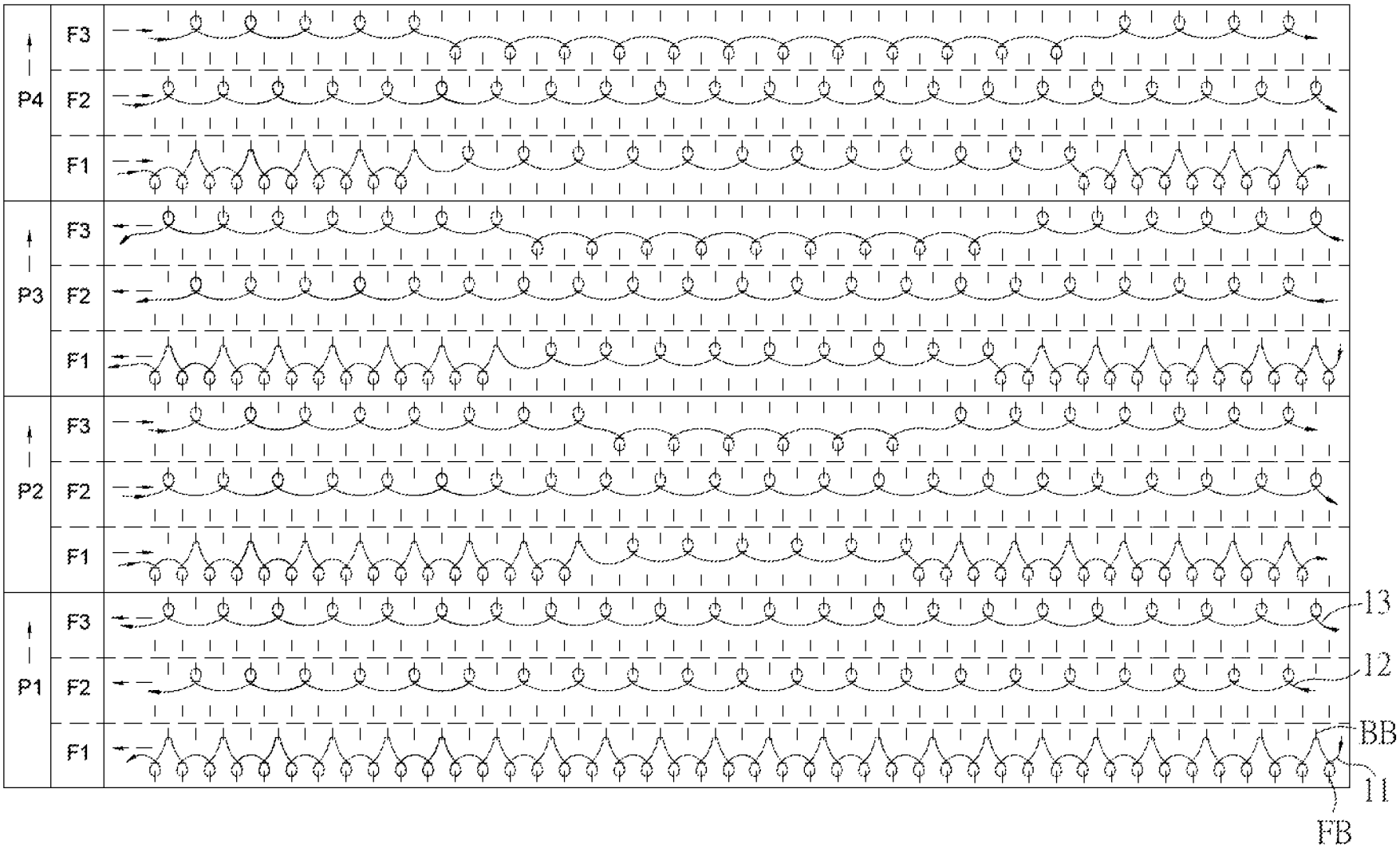
FIGS. 3 and 4 are schematic knitting diagrams of the region "A" of FIG. 1B.

Hereinafter, referring to FIG. 3 and FIG. 4 together with FIG. 1B and FIG. 2, an embodiment of the knitting process for the knitted fabric 10 of the invention by using the double-bed flat knitting machine will be illustrated. As shown in FIG. 3, the double-bed flat knitting machine includes a front needle bed FB disposed at the front and a back needle bed BB disposed at the back. Each of the front needle bed FB and the back needle bed BB has a plurality of needles. The needles of the front needle bed FB and the needles of the back needle bed BB are alternately disposed corresponding to each other from front to back in a one-to-one manner. Corresponding to the three sets of TPU yarns (e.g. 11, 12, 13), the flat knitting machine preferably has three cams (e.g. F1, F2, F3). Each cam (or yarn feeder) in corporation with the changeable rail paths can drive the actions of needles to perform the knitting process. It is noted that the sequence of the knitting periods P1 to P8 shown in FIG. 3 and FIG. 4 corresponds to the knitting direction indicated by the arrow in FIG. 1B.

As shown in FIG. 3, during the first knitting period P1, from right to left, by using the first cam F1, the first set of TPU yarns 11 is knitted on every needle of the front needle bed FB to form loops and tucked on every two needles of the back needle bed BB. In other words, the first set of TPU yarns 11 is knitted by forming two stitches on the front needle bed FB and then one tuck stitch on the back needle bed BB, and such a knitting manner is repeatedly performed on the front needle bed FB and the back needle bed BB. By using the second cam F2, the second set of TPU yarns 12 is knitted on the back needle bed BB to form one stitch (loop) on every two needles, i.e., form one stitch and then miss one. It is noted that the stitches formed by the second set of TPU yarns 12 are arranged on the needles of the back needle bed BB that have no tuck stitch previously formed by the first set of TPU yarns 11. By using the third cam F3, the third set of TPU yarns 13 is fed to the back needle bed BB to form one stitch (loop) on every two needles, i.e., form one stitch and then miss one. It is noted that the stitches formed by the third set of TPU yarns 13 are arranged on the needles of the back needle bed BB that have tuck stitches previously formed by the first set of TPU yarns 11, i.e., needles that have no stitch previously formed by the second set of TPU yarns 12, such as needles that are previously missed. As such, the plurality of loops (stitches) on needles of the front needle bed FB is formed by the first set of TPU yarns 11, and the plurality of loops (stitches) on needles of the back needle bed BB are alternately formed by the second set of TPU yarns 12 and the third set of TPU yarns 13. The plurality of loops on the front needle bed FB (e.g. the technical face 10*a*1) are disposed corresponding to the plurality of loops on the back needle bed BB (e.g. the technical back 10*b*1) in a one-to-one manner to form a continuous row of the flat plane region 110.

During the second knitting period P2, from left to right, by using the first cam F1, in the flat plane region 110, the first set of TPU yarns 11 is knitted on every needle of the front needle bed FB to form loops and tucked on every two needles of the back needle bed BB. In other words, the first set of TPU yarns 11 is knitted by forming two stitches on the front needle bed FB and then one tuck stitch on the back needle bed BB, and such a knitting manner is repeatedly performed on the front needle bed FB and the back needle bed BB. It is noted that during the current knitting period (e.g. P2), tuck stitches formed by the first set of TPU yarns 11 are arranged on needles of the back needle bed BB that have no tuck stitch of the first set of TPU yarns 11 formed in the previous knitting period (e.g. P1), i.e., needles of the back needle bed BB that have stitches of the second set of TPU yarns 12 formed in the previous knitting period (e.g. P1). When the knitting process continues from the flat plane region 110 to the concave-convex pattern region 120, the first cam F1 feeds the first set of TPU yarns 11 to corresponding needles of the back needle bed BB to form one stitch on every two needles. Specifically, in the concave-convex pattern region 120, stitches of the first set of TPU yarns 11 are arranged on needles of the back needle bed BB that have stitches of the second set of TPU yarns 12 formed in the previous knitting period (e.g. P1), i.e., needles of the back needle bed BB that have no stitch formed by the third set of TPU yarns 13 in the previous knitting period (e.g. P1). When the knitting process continues from the concave-convex pattern region 120 to the flat plane region 110, the knitting manner of the first set of TPU yarns 11 for the flat plane region 110 (i.e., two front stitches and then one back tuck stitch) is repeated, wherein tuck stitches are arranged on needles of the back needle bed BB that have stitches of the second set of TPU yarns 12 formed in the previous knitting period (e.g. P1).

Then, by using the second cam F2, the second set of TPU yarns 12 forms one stitch on every two needles of the back needle bed BB, i.e., form one stitch and then miss one. It is noted that stitches formed by the second set of TPU yarns 12 are arranged on needles of the back needle bed BB that have no tuck stitch (in the flat plane region) or no stitch (in the concave-convex pattern region) of the first set of TPU yarns 11 formed in the current knitting period (e.g. P2). That is, stitches of the second set of TPU yarns 12 formed in the current knitting period (e.g. P2) are arranged on needles of the back needle bed BB that have no stitch of the second set of TPU yarns 12 in the previous knitting period (e.g. P1).

By using the third cam F3, in the flat plane region 110, the third set of TPU yarns 13 forms one stitch on every two needles of the back needle bed BB, i.e., form one stitch and then miss one. It is noted that stitches of the third set of TPU yarns 13 are arranged on needles of the back needle bed BB that have tuck stitches of the first set of TPU yarns 11 formed in the current knitting period (e.g. P2). That is, stitches of the third set of TPU yarns 13 formed in the current knitting period (e.g. P2) are arranged on needles of the back needle bed BB that have no stitch of the third set of TPU yarns 13 in the previous knitting period (e.g. P1). When the knitting process continues from the flat plane region 110 to the concave-convex pattern region 120, the third cam F3 feeds the third set of TPU yarns 13 to corresponding needles of the front needle bed FB to form one stitch (loop) on every two needles, i.e., form one stitch and miss one. When the knitting process continues from the concave-convex pattern region 120 to the flat plane region 110, the third cam F3 feeds the third set of TPU yarns 13 to needles of the back needle bed BB to form one stitch on every two needles, i.e., form one stitch and miss one, wherein stitches of the third set of TPU yarns 13 formed in the current knitting period (e.g. P2) are arranged on needles of the back needle bed BB that have no stitch of the third set of TPU yarns 13 formed in the previous knitting period (e.g. P1). Consequently, the concave-convex pattern region 120 is interposed (disposed) in the flat plane region 110. In the flat plane region 110, stitches (loops) on needles of the front needle bed FB are formed by the first set of TPU yarns 11 (i.e., in the technical face 10*a*1), and stiches (loops) on needles of the back needle bed BB are alternately formed by the second set of TPU yarns 12 and the third set of TPU yarns 13 (i.e., in the technical back 10*b*1). In the concave-convex pattern region 120, stitches (loops) on needles of the front needle bed FB are formed by the third set of TPU yarns 13 (i.e., in the technical face 10*a*2), and stitches (loops) on needles of the back needle bed BB are alternately formed by the first set of TPU yarns 11 and the second set of TPU yarns 12 (i.e., in the technical back 10*b*2). In the concave-convex pattern region 120, the number of loops (stitches) on the front needle bed FB (the technical face 10*a*2) is less than the number of loops on the back needle bed BB (the technical back 10*b*2), for example, about ½ of the number of loops of the back needle bed BB.

During the third knitting period P3, from right to left, by using the first cam F1, the first set of TPU yarns 11 is knitted on the front needle bed FB and the back needle bed BB in a manner similar to the second knitting period P2. It is noted that in the flat plane region 11, tuck stiches of the first set of TPU yarns 11 formed in the current knitting period (e.g. P3) are arranged on needles of the back needle bed BB that have no tuck stitch of the first set of TPU yarns 11 in the previous knitting period (e.g. P2). In the concave-convex pattern region 120, stitches of the first set of TPU yarns 11 are arranged on needles of the back needle bed BB that have no stitch of the first set of TPU yarns 11 in the previous knitting period (e.g. P2). Then, by using the second cam F2, the second set of TPU yarns 12 forms one stitch on every two needles of the back needle bed BB, i.e., form one stitch and miss one. Stitches of the second set of TPU yarns 12 are arranged on needles of the back needle bed BB that have no stitch of the second set of TPU yarns 12 in the previous knitting period (e.g. P2). By using the third cam F3, the third set of TPU yarns 13 is knitted on the front needle bed FB and the back needle bed BB in a manner similar to the second knitting period P2. It is noted that in the flat plane region 110, stitches of the third set of TPU yarns 13 formed in the current knitting period (e.g. P3) are arranged on needles of the back needle bed BB that have no stitch of the third set of TPU yarns 13 in the previous knitting period (e.g. P2). In the concave-convex pattern region 120, stitches of the third set of TPU yarns 13 formed in the current knitting period (e.g. P3) are arranged on needles of the front needle bed FB that have no stitch of the third set of TPU yarns 13 in the previous knitting period (e.g. P2). In the concave-convex pattern region 120, the number of loops (stitches) of the first set of TPU yarns 11 on the back needle bed BB corresponds to the number of loops of the third set of TPU yarns 13 on the front needle bed FB, and the number of loops can be modified according to the desired concave-convex pattern. For example, in this embodiment, the number of loops is sequentially increased along the knitting direction indicated by the arrow in FIG. 2.

During the fourth knitting period P4, from left to right, by using the first cam F1, the first set of TPU yarns 11 is knitted on the front needle bed FB and the back needle bed BB in a manner similar to the second knitting period P2. It is noted that in the flat plane region 110, tuck stitches of the first set of TPU yarns 11 formed in the current knitting period (e.g. P4) are arranged on needles of the back needle bed BB that have no tuck stitch of the first set of TPU yarns 11 in the previous knitting period (e.g. P3). In the concave-convex pattern region 120, stitches of the first set of TPU yarns 11 formed in the current knitting period (e.g. P4) are arranged on needles of the back needle bed BB that have no stitch of the first set of TPU yarns 11 in the previous knitting period (e.g. P3). By using the second cam F2, the second set of TPU yarns 12 forms one stitch on every two needles of the back needle bed BB. Stitches of the second set of TPU yarns 12 formed in the current knitting period (e.g. P4) are arranged on needles of the back needle bed BB that have no stitch of the second set of TPU yarns 12 in the previous knitting period (e.g. P3). By using the third cam F3, the third set of TPU yarns 13 is knitted in the front needle bed FB and the back needle bed BB in a manner similar to the second knitting period P2. It is noted that in the flat plane region 110, stitches of the third set of TPU yarns 13 formed in the current knitting period (i.e., P4) are arranged on needles of the back needle bed BB that have no stitch of the third set of TPU yarns 13 in the previous knitting period (e.g. P3). In the concave-convex pattern region 120, stitches of the third set of TPU yarns 13 are arranged on needles of the front needle bed FB that have no stitch of the third set of TPU yarns 13 in the previous knitting period (e.g. P3). In the concave-convex pattern region 120, loops (stitches) on the front needle bed FB (i.e., in the technical face 10*a*2) are formed by the third set of TPU yarns 13, and loops (stitches) on the back needle bed BB (i.e., in the technical back 10*b*2) are alternately formed by the first set of TPU yarns 11 and the second set of TPU yarns 12. In the concave-convex pattern region 120, the number of loops (stitches) of the first set of TPU yarns 11 on the back needle bed BB corresponds to the number of loops of the third set of TPU yarns 13 on the front needle bed FB, and the number of loops (stitches) can be modified according to the desired concave-convex pattern. For example, in this embodiment, the number of loops is sequentially increased along the knitting direction indicated by the arrow in FIG. 2.

Figure 4:
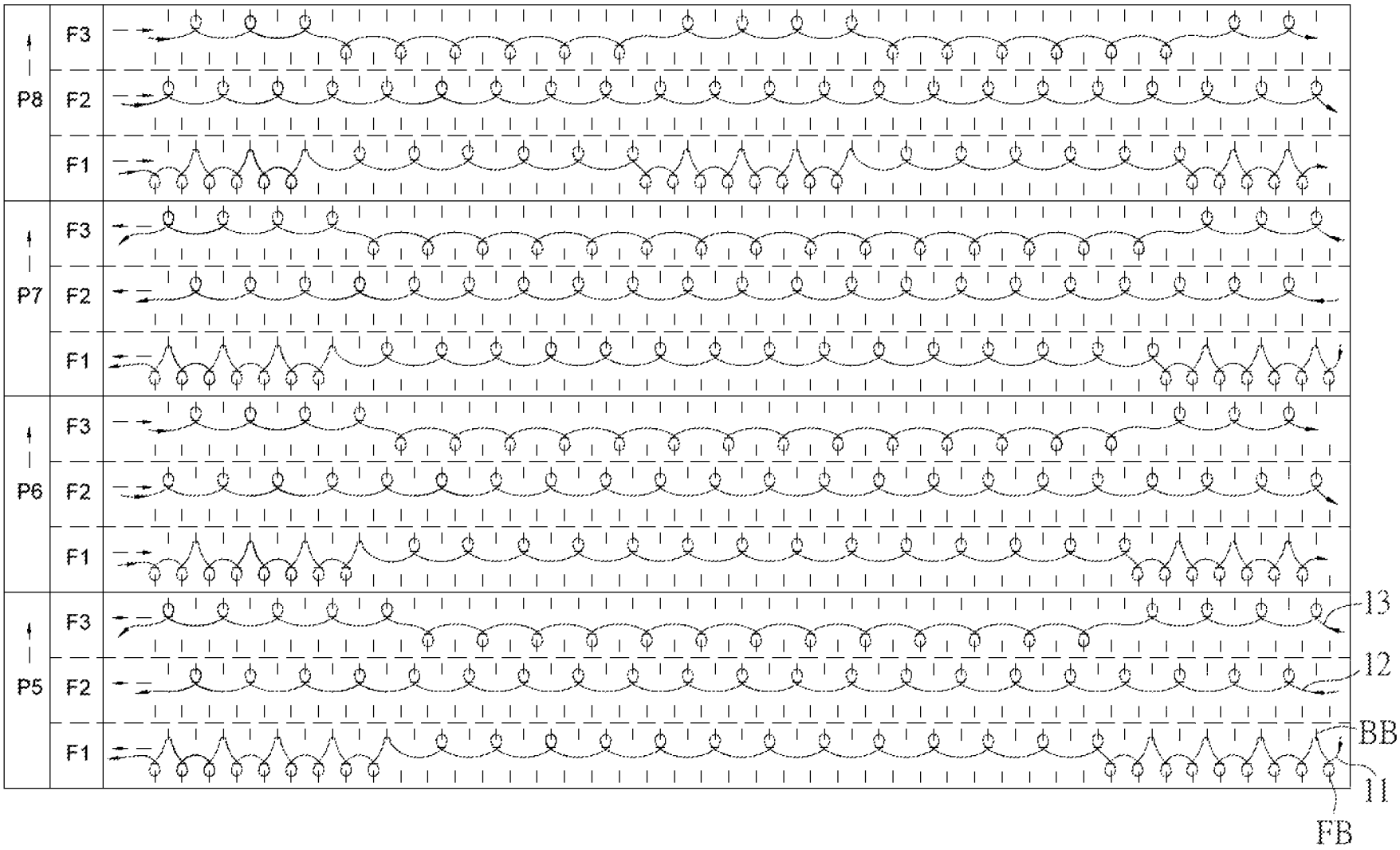

Referring to FIG. 4, during the fifth knitting period P5, the sixth knitting period P6, and the seventh knitting period P7, by using the first cam F1, the second cam F2, and the third cam F3, in a manner similar to the aforementioned knitting period (e.g. P2), each of the first set of TPU yarns 11 and the third set of TPU yarns 13 is knitted on the front needle bed FB and the back needle bed BB, and the second set of TPU yarns 12 is only knitted on the back needle bed BB, so sequentially knitting three rows of the knitted fabric 10 can be achieved. In each row of the flat plane region 110, loops (stitches) on the front needle bed FB are formed by the first set of TPU yarns 11, and loops (stitches) on the back needle bed BB are alternately formed by the second set of TPU yarns 12 and the third set of TPU yarns 13, wherein the number of loops (stitches) on the front needle bed FB (i.e., in the technical face 10*a*1) corresponds to the number of loops on the back needle bed BB (i.e., in the technical back 10*b*1) in a one-to-one manner. In each row of the concave-convex pattern region 120, loops (stitches) on the front needle bed FB (i.e., in the technical face 10*a*2) are formed by the third set of TPU yarns 13, and loops on the back needle bed BB (i.e., in the technical back 10*b*2) are alternately formed by the first set of TPU yarns 11 and the second set of TPU yarns 12, wherein the number of loops (stitches) on the front needle bed FB (i.e., in the technical face 10*a*2) is less than the number of loops on the back needle bed BB (i.e., in the technical back 10*b*2), for example, about ½ of the number of loops (stitches) on the back needle bed BB.

During the eighth knitting period P8, corresponding to the U-shaped region "A" of FIG. 1A, together with reference to FIG. 1B, a plurality of concave-convex pattern regions 120 can be formed in a same row. Specifically, the first knitting period P1 corresponds to the process of forming a full row of the flat plane region 110; the second knitting period P2 to the seventh knitting period P7 correspond to the processes of forming the bottom of the U-shaped concave-convex pattern; the eighth knitting period P8 corresponds to the process of forming two separate arms of the U-shaped concave-convex pattern. In other words, during the eighth knitting period P8, the first set of TPU yarns 11 is knitted on the front needle bed FB and the back needle bed BB in a manner to the aforementioned knitting period (e.g. P2), so the knitting manner (e.g. two front stitches and then one back tuck stitch) of forming the flat plane region can be executed on the concave-convex pattern region 120 formed in the previous knitting period (e.g. P7), for example, at middle section of the concave-convex pattern region. As such, two concave-convex pattern regions 120 can be formed at two opposite sides of the concave-convex pattern region 120 formed in the previous knitting period (e.g. P7), and the two concave-convex pattern regions 120 are separated by the flat plane region 110. The second cam F2 feeds the second set of TPU yarns 12 to form one stitch on every two needles of the back needle bed BB. Stitches of the second set of TPU yarns 12 are arranged on needles of the back needle bed BB that have no stitch of the second set of TPU yarns 12 in the previous knitting period (e.g. P7). By using the third cam F3, the third set of TPU yarns 13 is knitted on the front needle bed FB and the back needle bed BB in a manner similar to the second knitting period P2. In the flat plane region 110, stitches of the third set of TPU yarns 13 are arranged on needles of the back needle bed BB that have no stitch of the third set of TPU yarns 13 in the previous knitting period (e.g. P7). In the two concave-convex pattern regions 120, stitches of the third set of TPU yarns 13 are arranged on needles of the front needle bed FB that no stitch of the third set of TPU yarns 13 in the previous knitting period (e.g. P7). In each concave-convex pattern region 120, the number of loops (stitches) of the first set of TPU yarns 11 on the back needle bed BB corresponds to the number of loops of the third set of TPU yarns 13 on the front needle bed FB, and the number of loops can be modified according to the desired concave-convex pattern. For example, in this embodiment, the number of loops is decreased in the current knitting period. Moreover, in each concave-convex pattern region 120, the number of loops (stitches) on the front needle bed FB (or in the technical face 10*a*2) is still less than the number of loops on the back needle bed BB (or in the technical back 10*b*2), for example about ½ of the number of loops on.

From the above knitting periods P1~P8, it can be seen that the knitted fabric 10 of the invention can have a naturally formed concave-convex pattern by simple knitting techniques, such as stitch, miss, and tuck without using complicated knitting techniques, such as plating, transferring, or racking. Accordingly, the knitted fabric of the invention can be formed faster and smoothly to effectively improve the yield and productivity.

In the knitted fabric 10, the second set of TPU yarns 12 is configured to form only the technical back 10*b*. In other words, the second set of TPU yarns 12 is only knitted on the back needle bed BB. From another aspect, as shown in FIG. 2, in the configuration of the flat plane region 110, the first set of TPU yarns 11 is knitted on every needle of the front needle bed FB to form a plurality of "flat plane region front loops (stitches) (e.g. f1~f8)" and tucked on every two needles of the back needle bed BB to form a plurality of "flat plane region back tuck stitches (e.g. 111)", wherein the flat plane region back tuck stitches (e.g. 111) are located between the flat plane region front stitches (e.g. f1~f8). In the configuration of the flat plane region 110, the second set of TPU yarns 12 is knitted on every two needles of the back needle bed BB to form a plurality of "common back loops (stitches) (e.g. b2, b4, b6, b8)" and a plurality of "common back floating yarns (e.g. 121)", wherein the common back loops (e.g. b2, b4, b6, b8) are located between the flat plane region tuck stitches (e.g. 111). In the configuration of the flat plane region 110, the third set of TPU yarns 13 is knitted on every two needles of the back needle bed BB to form a plurality of "flat plane region back loops (stitches) (e.g. b1, b3, b5, b7)" and a plurality of "flat plane region back floating yarns (e.g. 131)" between the flat plane region back loops (e.g. b1, b3, b5, b7), wherein the flat plane region back loops (e.g. b1, b3, b5, b7) overlaps with the flat plane region back floating yarns (e.g. 131).

In the configuration of the concave-convex pattern region 120, the first set of TPU yarns 11 is knitted on every two needles of the back needle bed BB to form a plurality of "convex back loops (stitches) (e.g. c1, c3, c5, c7, c9)" and a plurality of "concave-convex region back floating yarns (e.g. 112)" between the convex back loops. In the configuration of the concave-convex pattern region 120, the second set of TPU yarns 12 is knitted on every two needles of the back needle bed BB to form a plurality of "common back loops (stitches) (e.g. c2, c4, c6, c8)" and a plurality of "common back floating yarns (e.g. 122)" between the common back stitches, wherein the common back stitches is spaced from the convex back stitches of the first set of TPU yarns 11 by one stitch. In the configuration of the concave-convex pattern region 120, the third set of TPU yarns 13 is knitted on every two needles of the front needle bed FB to form a plurality of "concave front loops (stitches) (e.g. c1'~c5')" and a plurality of "concave-convex region front floating yarns (e.g. 132)" between the concave front loops, wherein the concave front loops are located between the convex back loops (e.g. c1, c3, c5, c7, c9) of the first set of TPU yarns 11 and the common back stitches (e.g. c2, c4, c6, c8) of the second set of TPU yarns 12.

In the configuration of the concave-convex pattern region 120, the number of concave front loops is about ½ of the total number of convex back loops and common back loops, and the concave front loops are not interlaced with the convex back loops and the common back loops to form the hollow portion S. In the concave-convex pattern region 120, since the number of loops (stitches) in the technical face 10*a*2 is about ½ of the number of loops in the technical back 10*b*2, the obvious texture of concave technical face 10*a*2 and convex technical back 10*b*2 can be formed.

Moreover, in the configuration of the flat plane region 110, the number of flat plane region front loops (e.g. f1~f8) is identical to the total number of the common back loops (e.g. b2, b4, b6, b8) and the flat plane region back loops (e.g. b1, b3, b5, b7), and the flat plane region front loops are interlaced with the convex back loops and the common back loops by using the flat plane region back floating yarns. Since the number of loops (stitches) in the technical face 10*a*1 and the technical back 10*b*1 of the flat plane region 110 are identical and interlaced with each other by using the flat plane region back floating yarns, so the flat plane region back floating yarns enables the flat plane region 110 to have a feature of increased thickness.

Table 1 shows measurement data of TPU single-component yarns and conventional PET (polyethylene terephthalate) elastic yarn for shoes.

TABLE 1

DIN 53835-2 & ASTM D3412-2001 standards

| Items | Materials | Specification | Elongation rate % | Elastic recovery % | Friction coefficient |
|---|---|---|---|---|---|
| A yarn | TPU/ATY (air textured yarn) | 500d/96f | 122.1 | 86 | 0.128 |
| B yarn | TPU/POY (pre-oriented yarn) | 200d/48f | 161.7 | 67 | 0.083 |
| D yarn | TPU/DTY (draw textured yarn) | 165d/72f | 90.3 | 76 | 0.092 |
| E yarn (elastic yarn) | PET/DTY (draw textured yarn) | 300d/96f | 26.1 | 31 | 0.057 |

TPU yarn is a fiber material made of thermoplastic polyurethane elastomer through spinning process. TPU yarn is wear-resistant, twist-resistant, tear-resistant, solvent-resistant, flame-resistant, easy to shape (sustainable and durable), environmentally friendly, and recyclable, so can produce high-strength and high-abrasion-resistant fabrics through knitting methods. In the textile industry, TPU yarn can be processed to change its properties, fineness, and color and can be used in shoe uppers, backpacks, shoulder straps, carpets, table mats, seats, and other fabrics. The invention uses TPU single-component yarns without core material, which has high elasticity, high tenacity, and good softness, and importantly, TPU yarn has the characteristics of shape memory. Accordingly, the knitted fabric (or shoe upper) of the invention made of TPU yarns, in addition to having better wear resistance than PET fabrics, also takes advantage of the better shape memory (recovery rate) and friction coefficient characteristics of TPU yarns. Consequently, the concave-convex pattern of the knitted fabric (or shoe upper) of the invention can have the better concave-convex effect and the better shaping effect than PET fabric after the knitting process is completed.

Table 2 and Table 3 show measurement data of the knitted fabric 10 of the invention made of TPU single-component yarns and the knitted fabric made of conventional PET elastic yarns, wherein three sets of yarns all use the same material; A fabric: a knitted fabric of the invention made of A yarns (TPU/ATY); B fabric: a knitted fabric of the invention made of B yarns (TPU/POY); D fabric: a knitted fabric of the invention made of D yarns (TPU/DTY); E fabric: a conventional knitted shoe upper made of E yarns (PET/ATY).

TABLE 2

ASTM D2594 standard stretch
(knitted fabric – Elastic Recovery = (L1 – L2)/(L1 – L0))

| | knitted fabric | | | |
|---|---|---|---|---|
| parameters | A fabric | B fabric | D fabric | E fabric |
| weft fabric width (mm) | 420 | 432 | 428 | 448 |
| warp fabric length (mm) | 125 | 126 | 125 | 123 |
| weft length after sewing loops (mm) | 210 | 224 | 224 | 224 |
| (L0) without external force initial straight length after sewing loops (mm) | 210 | 216 | 214 | 224 |

TABLE 2-continued

ASTM D2594 standard stretch
(knitted fabric – Elastic Recovery = (L1 – L2)/(L1 – L0))

| | knitted fabric | | | |
|---|---|---|---|---|
| parameters | A fabric | B fabric | D fabric | E fabric |
| (L1) stretch 30% length after stretching (mm) | 273 | 281 | 278 | 291 |
| (L2) stretch 30% (for 2 hr then release) length measured after 60 sec (mm) | 216 | 236 | 226 | 253 |
| stretch 30% (for 2 hr then release) elastic recovery after 60 sec (%) | 90.5 (%) | 69.2 (%) | 81.3 (%) | 56.8 (%) |
| (L2) stretch 30% (for 2 hr then release) length measured after 0.5 hr (mm) | 215 | 234 | 225 | 252 |
| stretch 30% (for 2 hr then release) elastic recovery after 0.5 hr (%) | 92.1 (%) | 72.3 (%) | 82.8 (%) | 58.2 (%) |
| (L2) stretch 30% (for 2 hr then release) length measured after 1 hr (mm) | 214 | 234 | 224 | 252 |
| stretch 30% (for 2 hr then release) elastic recovery after 1 hr (%) | 93.7 (%) | 72.3 (%) | 84.4 (%) | 58.2 (%) |

TABLE 3

ASTM D2594 standard load
knitted fabric – elongation underload = (L1 – L0)/L0)

| | knitted fabric | | | |
|---|---|---|---|---|
| parameters | A fabric | B fabric | D fabric | E fabric |
| weft fabric width (mm) | 416 | 412 | 420 | 452 |
| warp fabric length (mm) | 128 | 122 | 126 | 127 |
| weft length after sewing loops (mm) | 208 | 206 | 210 | 226 |
| (L0) without external force initial straight length after sewing loops (mm) | 208 | 206 | 210 | 226 |
| (L1) first load 10(lb) for 5(sec) elongation after unloading (mm) | 221 | 222 | 221 | 235 |
| first elongation rate (%) | 6.25 (%) | 7.77 (%) | 5.24 (%) | 3.98 (%) |
| (L1) second load 10(lb) for 5(sec) elongation after unloading (mm) | 222 | 222 | 222 | 235 |
| second elongation rate (%) | 6.73 (%) | 7.77 (%) | 5.71 (%) | 3.98 (%) |
| (L1) third load10(lb) for 5(sec) elongation after unloading (mm) | 223 | 223 | 223 | 236 |
| third elongation rate (%) | 7.21 (%) | 8.25 (%) | 6.19 (%) | 4.42 (%) |
| (L1) fourth load 10(lb) for 5(sec) elongation after unloading (mm) | 224 | 224 | 224 | 237 |
| fourth elongation rate (%) | 7.69 (%) | 8.74 (%) | 6.67 (%) | 4.87 (%) |
| (L1) fifth load 10(lb) for 5(sec) elongation after unloading (mm) | 224 | 225 | 224 | 237 |
| fifth elongation rate (%) | 7.69 (%) | 9.22 (%) | 6.67 (%) | 4.87 (%) |
| average elongation rate (%) | 7.11 (%) | 8.35 (%) | 6.1 (%) | 4.42 (%) |

It can be seen from Table 2 and Table 3 that the knitted fabric 10 of the invention (i.e., A fabric, B fabric, D fabric)

has excellent performances over the conventional fabric (i.e., E fabric) in the fabric-elastic recovery and the fabric-elongation under load.

Compared with the prior art, the knitted fabric of the invention can have a naturally formed concave-convex pattern after knitting by controlling, in the concave-convex pattern region, the difference in the number of loops in the technical face and the technical back, eliminating the need of a mold for hot-pressing to form the concave-convex pattern and the consideration of using yarn materials with different thermal shrinkage rates, which are knitted and then heated to shrink them into a concave-convex shape. Moreover, the knitted fabric of the invention can be thermally treated at lower temperature for a short period of time to further shape the knitted fabric (or shoe upper) that already has the concave-convex pattern. The knitted fabric of the invention using at least three sets of TPU yarns can reduce the fabric defects caused by different tensions, different friction resistances, or different elasticity of using yarns of different materials, effectively improve the yield and throughput.

Although the preferred embodiments of the present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A knitted fabric knitted from at least three sets of thermoplastic polyurethane (TPU) yarns, the knitted fabric having a technical face and a technical back opposite to each other, the knitted fabric having a concave-convex pattern region and a flat plane region continuously knitted with the concave-convex pattern region, wherein:

in the flat plane region, loops in the technical face are disposed corresponding to loops in the technical back in a one-to-one manner;

in the concave-convex pattern region, a number of loops in the technical face is less than a number of loops in the technical back, so the concave-convex pattern region is arched toward the technical back with respect to the flat plane region; and in the concave-convex pattern region, the loops in the technical face are disposed corresponding to the loops in the technical back at interval, so the technical face is concave, and the technical back is convex.

2. The knitted fabric of claim 1, wherein the at least three sets of TPU yarns comprise a first set of TPU yarns, a second set of TPU yarns, and a third set of TPU yarns; all of the TPU yarns of the first set of TPU yarns, the second set of TPU yarns, and the third set of TPU yarns are all consists of TPU.

3. The knitted fabric of claim 2, wherein the first set of TPU yarns, the second set of TPU yarns, and the third set of TPU yarns independently include one or more yarns selected from a group consisting of a TPU air textured yarn, a TPU pre-oriented yarn, a TPU draw textured yarn, and a combination thereof.

4. The knitted fabric of claim 3, wherein the first set of TPU yarns, the second set of TPU yarns, and the third set of TPU yarns comprise a same TPU yarn.

5. The knitted fabric of claim 2, wherein the first set of TPU yarns and the second set of TPU yarns have a same number of yarns; the number of yarns of each of the first set of TPU yarns and the second set of TPU yarns is larger than a number of yarns of the third set of TPU yarns.

6. The knitted fabric of claim 5, wherein the number of yarns of each of the first set of TPU yarns and the second set of TPU yarns is two or more; the number of yarns of the third set of TPU yarns is equal to one or more than one, and less than the number of yarns of the first set of TPU yarns or the second set of TPU yarns by at least one yarn.

7. The knitted fabric of claim 2, wherein the second set of TPU yarns is configured to form only the technical back of the knitted fabric.

8. The knitted fabric of claim 7, wherein in the concave-convex pattern region, the loops in the technical face are formed by the third set of TPU yarns; the loops in the technical back are alternately formed by the first set of TPU yarns and the second set of TPU yarns.

9. The knitted fabric of claim 1, wherein a tightness of the concave-convex pattern region is 1.4 to 1.8 times of a tightness of the flat plane region.

10. The knitted fabric of claim 1, wherein in the knitted fabric, an area of a vertical projection of the flat plane region on a plane is larger than an area of a vertical projection of the concave-convex pattern region on the plane.

11. The knitted fabric of claim 1, wherein in the concave-convex pattern region, the loops in the technical face are not interknitted with the loops in the technical back to form a hollow portion.

12. The knitted fabric of claim 1, wherein in the concave-convex pattern region, a number of the loops in the technical face is defined as Nf; a number of the loops in the technical back is defined as Nb; a relationship of Nf and Nb satisfies $(\frac{1}{2}\times Nb)-1 \leq Nf \leq (\frac{1}{2}\times Nb)+1$, wherein Nf and Nb are both positive integers.

13. The knitted fabric of claim 1, wherein the knitted fabric is a knitted shoe upper.

14. A knitted fabric knitted from at least three sets of thermoplastic polyurethane (TPU) yarns, the knitted fabric having a technical face and a technical back opposite to each other, the knitted fabric having a concave-convex pattern region and a flat plane region continuously knitted with the concave-convex pattern region, wherein:

in the flat plane region, loops in the technical face are disposed corresponding to loops in the technical back in a one-to-one manner; and in the concave-convex pattern region, a number of loops in the technical face is less than a number of loops in the technical back, so the concave-convex pattern region is arched toward the technical back with respect to the flat plane region; and a tightness of the concave-convex pattern region is 1.4 to 1.8 times of a tightness of the flat plane region.

* * * * *